US005605081A

United States Patent [19]

Chen et al.

[11] Patent Number: 5,605,081

[45] Date of Patent: Feb. 25, 1997

[54] STRUCTURE OF WRENCH

[76] Inventors: Johnny Chen, No. 23, Alley 1, Lane 27, Hwa Hsi Street; Joseph Chow, 9F., No. 82, Sec. 2, An Ho Rd., both of Taipei, Taiwan

[21] Appl. No.: 567,241

[22] Filed: Dec. 5, 1995

[51] Int. Cl.[6] ..... B25B 23/14

[52] U.S. Cl. ..... 81/467; 81/DIG. 5

[58] Field of Search ..... 81/467–483, DIG. 5

[56] References Cited

U.S. PATENT DOCUMENTS

| | | | |
|---|---|---|---|
| 3,487,732 | 1/1970 | Larson | 81/467 |
| 3,503,362 | 3/1970 | Ollagnon | 81/477 X |
| 4,348,922 | 9/1982 | Harris et al. | 81/180.1 |
| 4,761,989 | 8/1988 | McDevitt | 81/473 X |
| 4,901,610 | 2/1990 | Larson et al. | 81/473 |
| 4,905,731 | 3/1990 | Tamashiro et al. | 81/52 X |

*Primary Examiner*—D. S. Meislin
*Attorney, Agent, or Firm*—Bacon & Thomas

[57] ABSTRACT

A wrench including an operation arm having an operation head at one end for turning a workpiece, a calibration handle connected to one end of the operation arm and turned relative to the operation arm to set the desired index number of torsion, and a lock controlled to lock the calibration handle when the desired index number is set, wherein a transparent socket is mounted around the calibration handle adjacent to the operation arm, having a lens, which magnifies the index number of torsion for accurate calibration.

2 Claims, 2 Drawing Sheets

STRUCTURE OF WRENCH

BACKGROUND OF THE INVENTION

The present invention relates to wrenches, and relates more particularly to such a wrench which can magnify the index number of torsion for an accurate calibration.

For turning a screw or a nut, a wrench or the like may be used. In certain cases, the tightness of the screw or nut must be accurately controlled. If an excessive torsional force is applied to the screw or nut, the thread tend to be damaged. If the thread of the screw or nut is damaged, the required air tight condition cannot be achieved. However, it is difficult to accurately control the tightness of the screw or nut when it is turned by a regular wrench. There is known a wrench which can be adjusted to calibrate the desired torsional force. This structure of wrench comprises an operation arm having an operation head at one end for turning a workpiece, a calibration handle connected to the operation arm at one end remote from the operation arm and turned relative to the operation arm to set the desired index number of torsion. When the reaction force from the screw or nut surpasses the set torsional force, the wrench will run idle. This structure of wrench is functional. However, because the indexes on the operation arm adjacent to the calibration handle and the graduations on the calibration handle are made of small scale, they cannot be easily distinguished. Therefore, a reading error tends to occur during the calibration.

SUMMARY OF THE INVENTION

The present invention has been accomplished under the circumstances In view. It is one object of the present invention to provide a wrench which has a lens to magnify the index number of torsion for an accurate calibration. It is another object of the present invention to provide a wrench which has means to protect the lens, which magnifies the index number of torsion.

DETAILED DESCRIPTION OF THE PREFERRED EMBODIMENT

Figure 1:
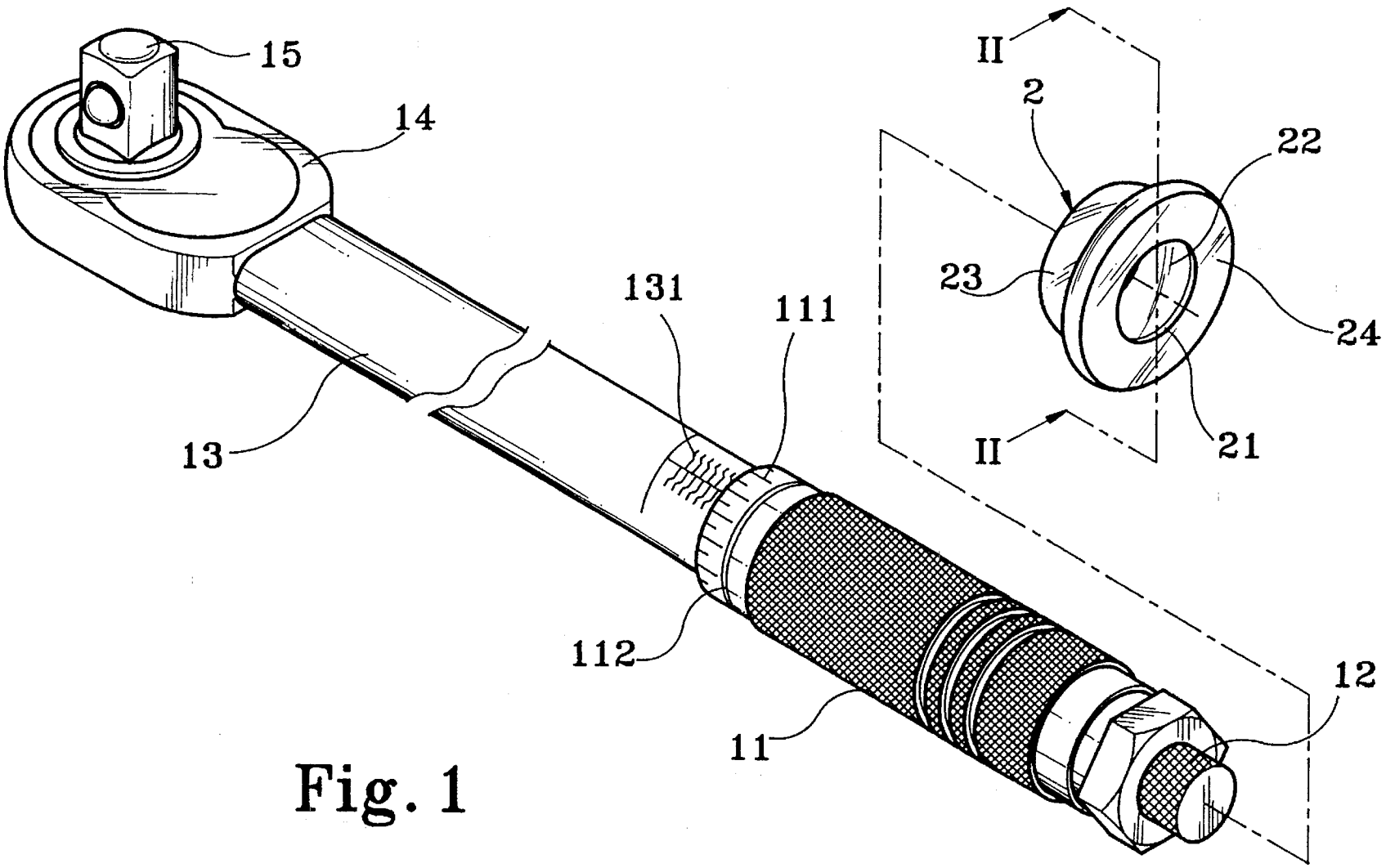
FIG. 1 is an exploded view of a wrench according to the present invention.
Figure 3:
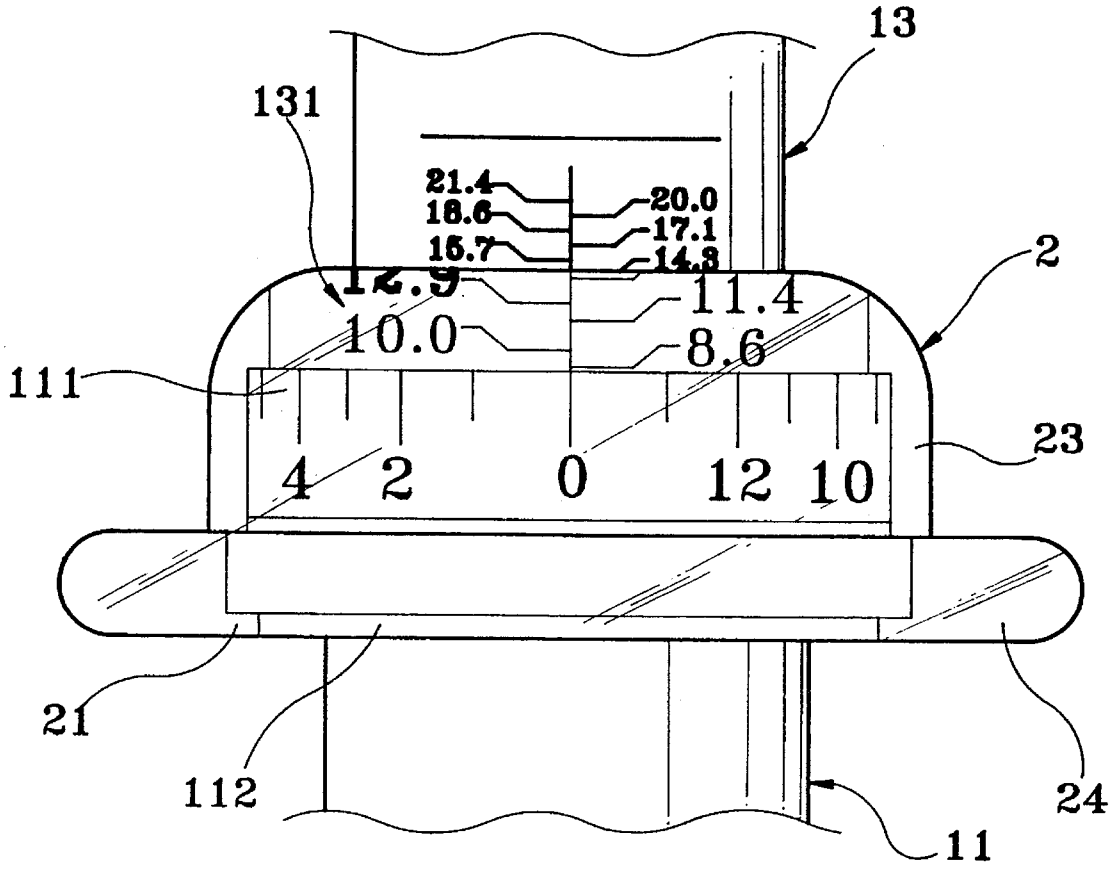
FIG. 3 shows the indexes of the operation arm and the graduations of the calibration handle magnified by the lens according to the present invention.

Referring to FIG. 1, a wrench in accordance with the present invention is generally comprised of a calibration handle 11, a lock screw 12, an operation arm 13, an operation head 14, and a transparent socket 2. The operation head 14 is fixedly secured to the operation arm 13 at one end, having a driving tip 15 for mounting socket wrench accessories for turning screws and nuts. The calibration handle 11 is fastened to the operation arm 13 at an opposite end remote from the operation head 14, and turned relative to the operation arm 13 to set the desired index of torsion. The lock screw 12 is fastened to the calibration handle 11 at one end, and controlled to lock the calibration handle 11 when the desired index number of torsion is set. The transparent socket 2 is mounted around the connecting area between the operation arm 13 and the calibration handle 11 to magnify the index number of torsion.

Referring to FIG. 1 again, the operation arm 13 has indexes 131 adjacent to the calibration handle 11; the calibration handle 11 has graduations 111 corresponding to the indexes 131, and is turned relative to the operation arm 12 to set the desired index number of torsion.

Figure 2:
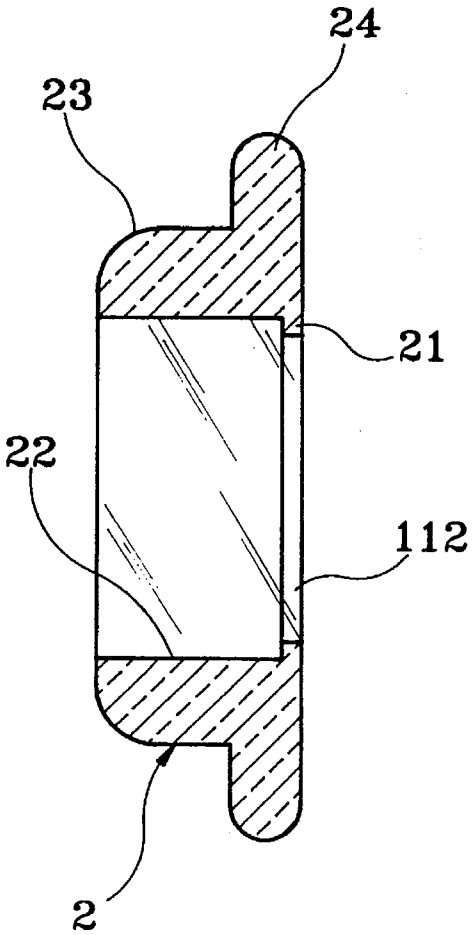
FIG. 2 is a cross section in an enlarged scale of the transparent socket according to the present invention.

Referring to FIG. 2 and FIG. 1 again, the calibration handle 11 has an annular groove 112 around the periphery adjacent to graduations 111; the transparent socket 2 comprises a center through hole 22, which receives the calibration handle 11, an inside annular flange 21 raised from the center through hole 22 at one end and forced into engagement with the annular groove 112 of the calibration handle 11, an arched lens 23 at one side around the periphery to magnify the index number of torsion shown on the indexes 131 and the graduations 111, and an outward flange 24 for protection. When the wrench is placed on the ground or received inside a tool box, the outward flange 24 lifts the arched lens 23 from the ground or the wall of the tool box to prevent direct rubbing of the arched lens 23 against the ground or the wall of the tool box. Through the arched lens 23 of the transparent socket 2, the user can accurately adjust the index number of torsion.

It is to be understood that the drawings are designed for purposes of illustration only, and are not intended as a definition of the limits and scope of the invention disclosed.

I claim:

1. A wrench comprising an operation arm having an operation head at one end for turning a workpiece, a calibration handle connected to said operation arm at one end remote from said operation arm and turned relative to said operation arm to set the desired index number of torsion, and a lock screw controlled to lock said calibration handle when the desired index number is set, wherein said calibration handle has an annular groove around the periphery adjacent to said operation arm; a transparent socket is mounted around said calibration handle, having an inside annular flange forced into engagement with the annular groove of said calibration handle, and an arched lens at one side around the periphery to magnify indexes on said operation arm.

2. The wrench of claim 1 wherein said transparent socket has an outward flange of outer diameter bigger than that of said arched lens.

* * * * *